US005671582A

United States Patent [19]

Reay

[11] Patent Number: 5,671,582

[45] Date of Patent: Sep. 30, 1997

[54] FLOOR TO WALL TIE METHOD OF CONSTRUCTION

[75] Inventor: Alan Michael Reay, Christchurch, New Zealand

[73] Assignee: Engineering Certifiers Limited, Christchurch, New Zealand

[21] Appl. No.: 518,199

[22] Filed: Aug. 23, 1995

[30] Foreign Application Priority Data

Oct. 3, 1994 [NZ] New Zealand ..... 264597

[51] Int. Cl.[6] ..... E04B 1/00

[52] U.S. Cl. ..... 52/745.05; 52/259; 52/583.1; 52/432

[58] Field of Search ..... 52/251, 253, 259, 52/583.1, 236.6, 236.7, 324, 309.12, 745.05, 432

[56] References Cited

U.S. PATENT DOCUMENTS

| | | | |
|---|---|---|---|
| 1,061,665 | 3/1913 | Easterday | 52/583.1 X |
| 1,764,729 | 6/1930 | Koch | 52/513 X |
| 1,791,108 | 2/1931 | Venzie | 52/583.1 |
| 2,160,773 | 5/1939 | Wolfe | 52/583.1 |
| 2,675,694 | 4/1954 | Betsold | 52/583.1 X |
| 3,645,056 | 2/1972 | Gerola | 52/259 |
| 3,803,788 | 4/1974 | Artmann | 52/583.1 X |
| 3,832,817 | 9/1974 | Martens | 52/259 X |
| 4,240,233 | 12/1980 | Vercelletto | 52/565 X |

FOREIGN PATENT DOCUMENTS

| | | | |
|---|---|---|---|
| 2742523 | 3/1979 | Germany | 52/259 |

*Primary Examiner*—Carl D. Friedman
*Assistant Examiner*—Winnie Yip
*Attorney, Agent, or Firm*—Ross, Ross & Flavin

[57] ABSTRACT

A method of construction of a multi-storey building which comprises precasting side slab walls (3) with a plurality of cavities (6). The pre-casting includes incorporating shaped lengths of steel bars (8,9) so that one or more lengths pass through each cavity (6). Tie elements (20, 30, 40 or 50) inter-engage with the bar (9) and are secured to the slab floor slab (4) by a concrete or other topping (5), which together form the floor unit (2). The ties can be secured to the bar by a pin (11) once the tie is engaged with or about the bar (9), but may perform this function without a pin. The ties can be one of a number of embodiments.

4 Claims, 3 Drawing Sheets

FLOOR TO WALL TIE METHOD OF CONSTRUCTION

BACKGROUND OF THE INVENTION

The present invention relates to an improved method of construction of multi-storey buildings using pre-cast concrete floor units. More specifically, the present invention relates to a method of construction which provides a tensile connection between cast floor and wall elements which, when overloaded, fails in a ductile manner.

At present, there are two general methods of construction for a tensile connection between concrete walls and floors. If such connections are going to fail at all, it is desirable that the failure be in the tie element and be a ductile failure.

In the first method, reinforcing bars are pre-cast in wall elements at regular spacings adjacent the intended final position of a floor slab. Each bar is bent out at right angles so that one end is embedded in the wall and one end is tied to the floor slab when a topping is poured on the floor slab in situ. However, the protruding ends do not allow for easy stacking of wall elements prior to use and sometimes make the installation of floor slabs extremely difficult.

The second method incorporates a screw threaded element attached to reinforcing rods within the wall element. A threaded bar is attached to the screw-threaded element and tied to the floor slab in the same manner as described above. This overcomes the difficulties of the first method but is a more expensive method of connection. A further disadvantage is that with the presence of screw threads, if failure occurs, one cannot reliably get ductile failure of the metal element. Further, with both methods the strength of the tie is limited by the thickness of the concrete wall available and a single bar anchorage.

BRIEF SUMMARY OF THE INVENTION

An object of the present invention is the provision of a method of construction of multi-storey buildings using slab floors which overcomes the disadvantages of the above-described, known methods, such that failure of the tie elements will be reliably a ductile failure. A further object of the present invention is the provision of a building method that spreads the floor load to a greater wall area than is presently possible, thus allowing a higher strength connection.

The present invention provides a method of construction of a building with two or more storeys, using pre-cast units, said method comprising:

casting a plurality of side slab walls in concrete from a mould, said mould including a plurality of cavities into each of which a shaped piece of light packing material has been inserted, each cavity being positioned adjacent a surface of the slab which surface becomes an inner wall surface when said slab is in position in a building, and wherein one or more shaped lengths of steel bar are inserted in the mould such that one or more shaped lengths pass through the cavity and a shaped portion of each length is positioned, with the base of the shaped portion outermost, adjacent (or protruding through) the surface of the slab which surface becomes an inner wall surface;

positioning said side slab walls on site;

providing one or more floor slabs of appropriate dimensions for each floor or storey of said building;

positioning each floor slab in its final position;

inserting a shaped steel tie to inter-engage with said shaped portion of said steel bar; and securing each end of said tie to the floor slab or/and covering the tie with a topping or infill.

Preferably said method further includes placement of each cavity within each side wall such that a thin wall of cast material forms over said cavity during casting. Said thin wall can be broken away to reveal the cavity either before the wall is positioned on site, or after.

Said shaped steel tie may be one of a number of configurations, some of which inter-engage with the steel bar with the addition of a pin, and some of which need no additional element to inter-engage with said steel bar.

BRIEF SUMMARY OF THE DRAWINGS

By way of example only, a preferred embodiment of the present invention is described in detail with reference to the accompanying drawings, in which.

DETAILED DESCRIPTION

Figure 2:
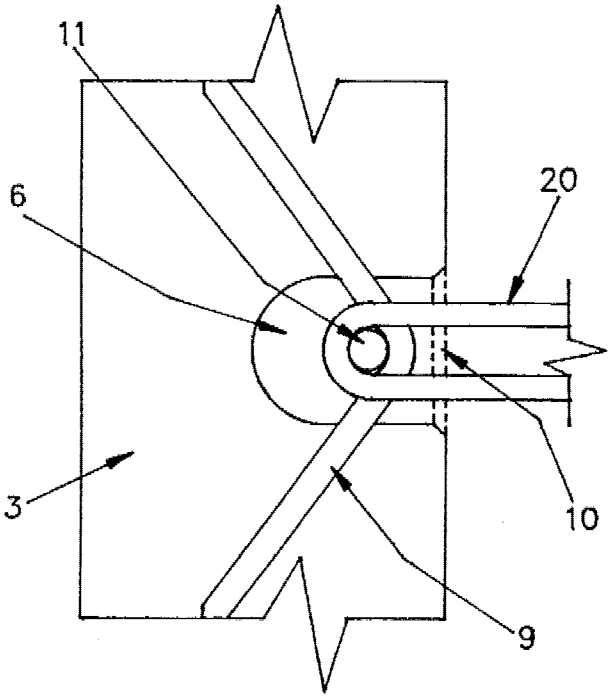
FIG. 2 is an enlargement of the point of inter-engagement shown in FIG. 1.
Figure 1:
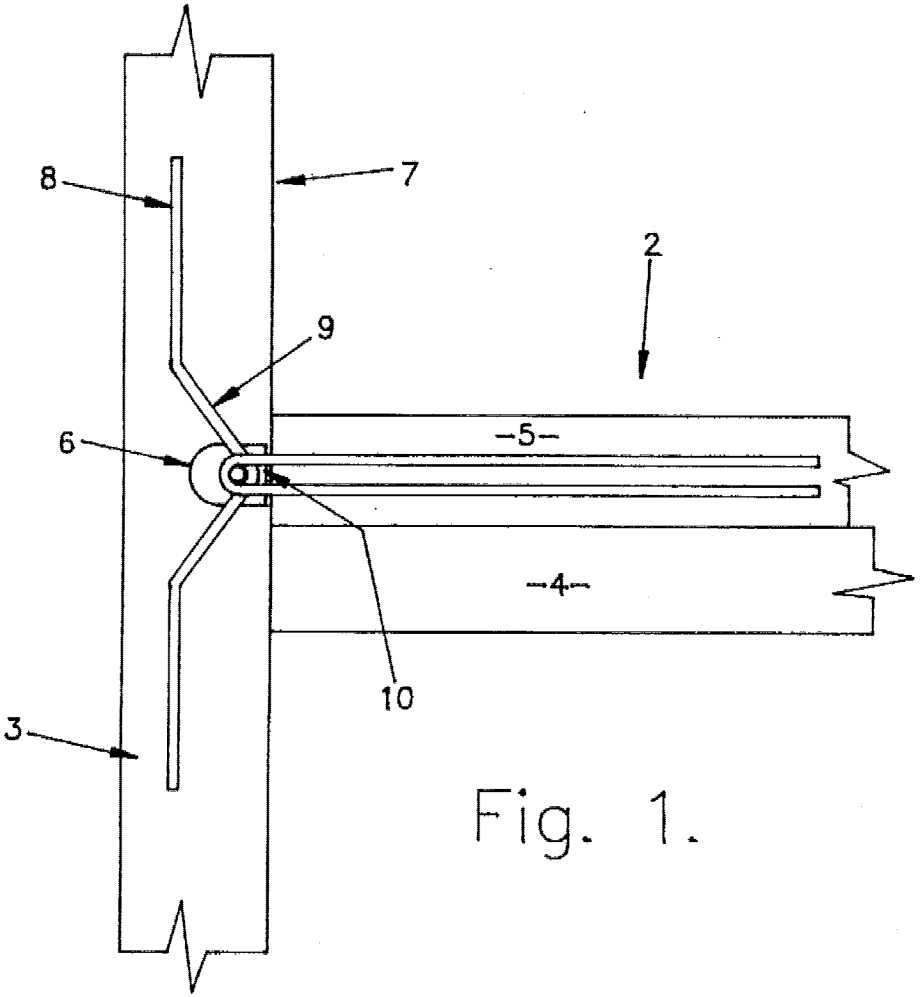
FIG. 1 is a section view of a side wall and slab floor constructed in accordance with the method of the present invention.

Referring to FIGS. 1 and 2, a slab floor 2 is shown secured to a side wall 3 of a building. The slab floor 2 has a lower, pre-cast concrete floor 4 which is pre-cast in a mould (not shown) either on or off site. A concrete topping or infill 5 is shown but this is not added until after the floor 2 is in position. The floor 2 can be at any or all levels of a building of two or more storeys.

Figure 7:
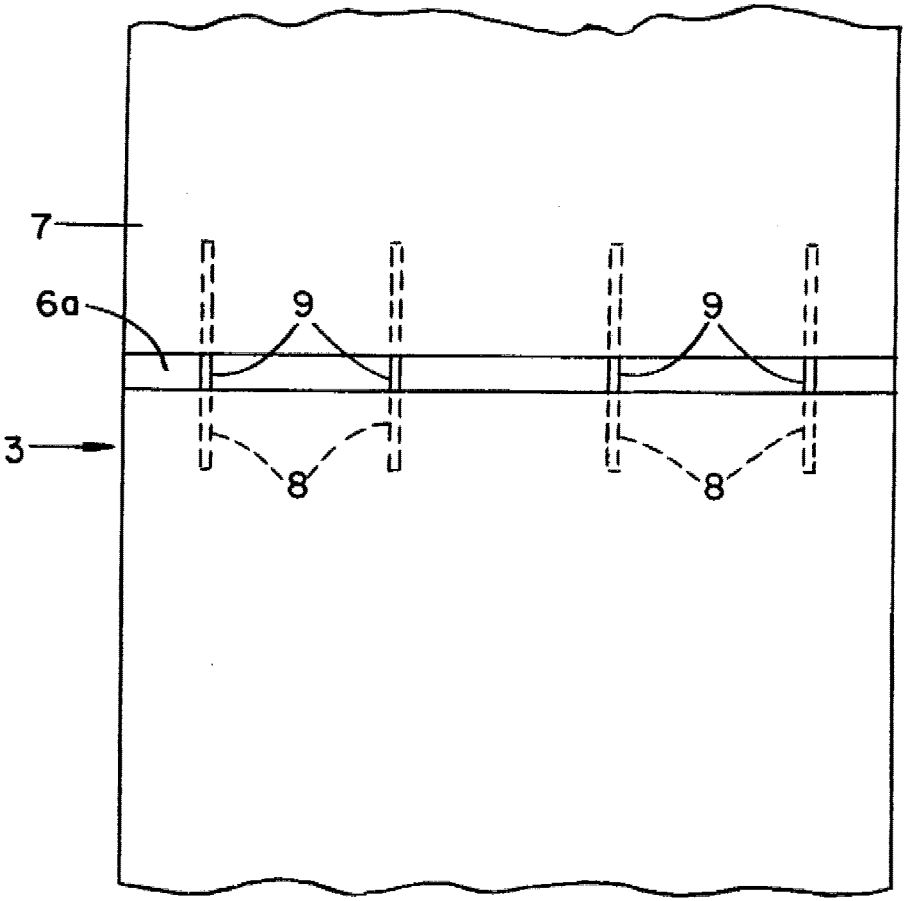
FIG. 7 is a fragmentary side elevational view of a side wall showing a continuous cavity thereacross

The wall 3 is cast either on or off site with a plurality of small cavities 6 positioned adjacent the inner surface 7 of the wall 3. Each cavity 6 is partly formed by the insertion of a shaped polystyrene former (not shown) in the mould prior to the casting of the wall 3. A shaped steel bar 8 is positioned so that it will be perpendicular to the floor slab 2 when the floor slab 2 is in position. There may be a plurality of cavities 6 or a continuous slot 6*a* as shown in FIG. 7 may be formed, as is desired. Also, the bar 8 may be at any angle to the floor slab 2, if so desired.

The bar 8 is shaped with a bent V portion 9, the outermost point of which is positioned within the cavity 6, prior to the casting of the wall 3. When the wall 3 is cast a small breakaway wall portion 10 is formed over the cavity 6. The number and position of each cavity 6, the size of each cavity 6, the thickness of the breakaway portion 10 and the point of the outermost end of the V shaped portion 9 can all be pre-determined. Also, if desired, the outermost point of the V portion 9 could protrude through the surface of the wall 3.

Figure 3:
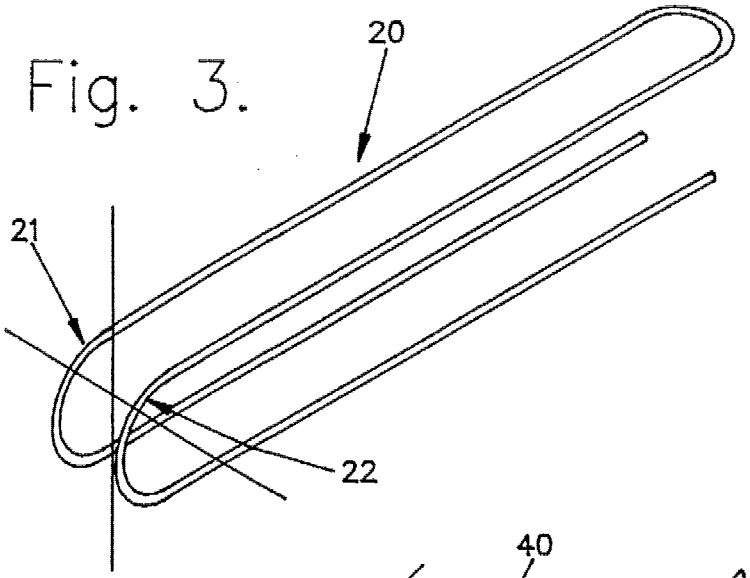
FIG. 3 is a perspective view of a first preferred embodiment of the tie of the present invention.

Referring to FIGS. 3 to 6, four different embodiments of a tie bar are thereshown. In FIG. 3 the tie bar 20 is of folded steel rod. This first preferred embodiment is the tie bar 20 shown in engagement with the V portion 9 of the bar 8 in FIG. 2. The V shaped portion 9 fits between two limbs 21, 22, of the tie bar 20. A metal pin 11 (FIG. 2) is used to ensure complete inter-engagement between the tie 20 and bar 8. Washers and nuts (not shown) may be used to aid in the securement of the pin 11 between the tie 20 and bar 8, if so desired.

Figure 4:
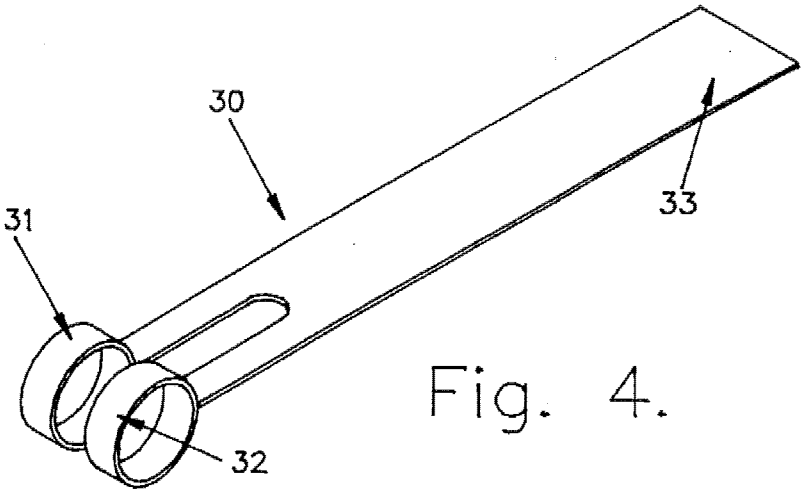
FIG. 4 is a perspective view of a second preferred embodiment of the tie of the present invention.

FIG. 4 shows a second preferred embodiment of the tie 30. The tie 30 has two limbs 31 and 32 which fit about the V shaped portion 9 of the bar 8 when the tie 30 and bar 8 inter-engage. The tie 30 is retained in position by the pin 11. The second end of the tie 30 is formed from a steel flat 33, with the limbs 31, 32 being formed from the first flat end of the steel flat, after that first end has been slotted, rolled to fit around the dimensions of the bar 8 and welded into the shape shown in FIG. 4.

Figure 5:
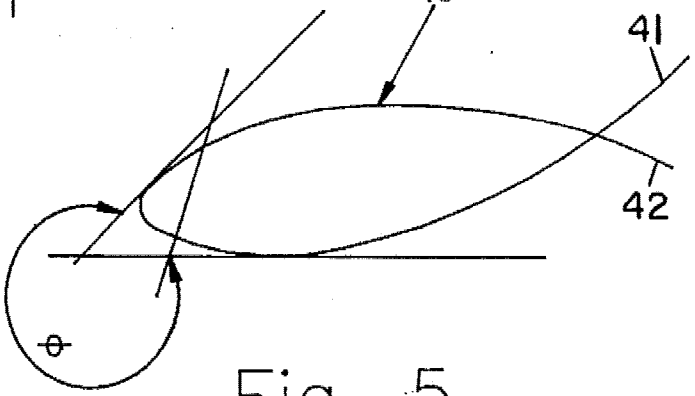
FIG. 5 is a perspective view of a third preferred embodiment of the tie of the present invention.

FIG. 5 shows a third preferred embodiment of the tie 40 shaped in a curve with one end 41 crossing over, but not touching, the second end 42. The angle of the curve, shown by the angle θ on FIG. 5, is dependent on the width of the cavity 6. If, for example a continuous slot is used for the cavity 6 the angle θ can be smaller than if a narrow cavity 6 is used.

Figure 6:
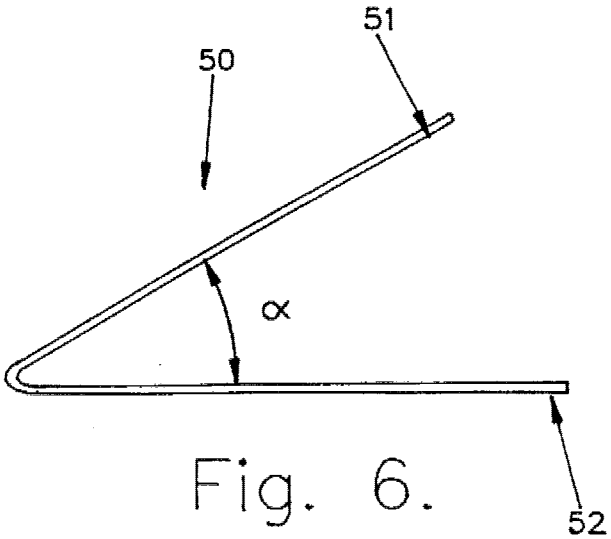
FIG. 6 is a perspective view of a fourth preferred embodiment of the tie of the present invention.

FIG. 6 shows a fourth preferred embodiment of the tie 50. The tie 50 has two straight limbs 51, 52 and is made from a length of a steel bar. The value of the angle α between the two limbs 51, 52 will depend on the width of the cavity 6, the thickness of the bar 8 and characteristics of the bar 8.

The third and fourth embodiments of the tie (40, 50) inter-engage with the bar 8 by inserting one limb of the tie 40, 50 under the V shaped portion 9 and drawing the tie 40, 50 through the cavity 6 until the head of the tie 40, 50 is engaged with the bar 8. Thus with these ties 40, 50 no pin 11 is required. However there is a requirement that the width of the cavity 6 be greater than that necessary for the use of the first and second embodiment of the ties 20, 30.

The method of construction is as follows: the floor slab 4 is pre-cast on or off site. The walls 3 are fixed in position by known means. The breakaway wall 10 is broken and removed (either before or after location of the walls 3, as is desired). The cavity 6 is cleared of any polystyrene or other formers.

A tie 20 (or 30, 40 or 50) is engaged with each bar 8 as described above. A pin 11 is inserted if the tie used requires one to secure the tie (20, 30) in place. The ties 20 may be inserted in position before the floor is positioned, if so desired. The topping or infill 5 is poured. This fills the cavities 6 (fully or partly, as desired) and covers the ties 20, securing the to the floor slab 4 and within the finished floor. Once the infill 5 is cured the temporary props are removed. Slab floor 2 could be of timber, if so desired. The tie bars 20, 30, 40, 50 would be secured by known means.

The diameter of the bar 8 and ties (20, 30, 40, 50) may be varied depending on the building design parameters, to ensure that if ductile failure occurs, it occurs in the V shaped portion 9, as required. The bar 8 and ties (20, 30, 40, 50) may be of any appropriate metal or material, for example reinforcing steel.

I claim:

1. In a method of construction of a building of two or more storeys comprising:

a) precasting in a mould a plurality of concrete walls each defining outer and inner wall surfaces with each inner wall surface being inclusive of a plurality of inwardly-extending cavities formed by a packing material strategically positioned in the mould preliminary to the moulding and with shaped lengths of metal bars so positioned within the mould that an engageable portion of each metal bar is extendable into a respective cavity-defining area preliminary to the moulding;

b) removing the packing materials from the formed cavities of the walls;

c) precasting in a mould a plurality of floor slabs of appropriate dimensions;

d) positioning the walls and floor slabs in respective positions on the site;

e) securing metal floor tie bars to the floor slabs with engageable outboard tie bar portions being extendable outwardly from each floor slab end;

f) interengaging the engageable outboard portion of the floor tie bar with a respective engageable portion of the side wall metal bar;

g) covering the floor tie bars with a topping; and h) with each tie bar being retained in position with the metal bar pin element, each tie bar having two limbs and being formed from a metal flat and the limbs formed from a first flat, end, after said end has been slotted and rolled to fit around the metal bar circumferential dimensions and welded into shape.

2. In a method of construction of a building of two or more storeys comprising:

a) precasting in a mould a plurality of concrete walls each defining outer and inner wall surfaces with each inner wall surface being inclusive of a plurality of inwardly-extending cavities formed by a packing material strategically positioned in the mould preliminary to the moulding and with shaped lengths of metal bars so positioned within the mould that an engageable portion of each metal bar is extendable into a respective cavity-defining area preliminary to the moulding;

b) removing the packing materials from the formed cavities of the walls;

c) precasting in a mould a plurality of floor slabs of appropriate dimensions;

d) positioning the walls and floor slabs in respective positions on the site;

e) securing metal floor tie bars to the floor slabs with engageable outboard tie bar portions being extendable outwardly from each floor slab end;

f) interengaging the engageable outboard portion of the floor tie.bar with a respective engageable portion of the side wall metal bar;

g) covering the floor tie bars with a topping; and h) wherein a tie bar is provided with two limbs formed from a metal flat, the limbs being formed from the first flat end, after the flat end has been slotted and rolled to fit the tie bar circumferential dimensions and welded into shape.

3. In a method of construction of a building of two or more storeys comprising:

a) precasting in a mould a plurality of concrete walls each defining outer and inner wall surfaces with each inner wall surface being inclusive of a plurality of inwardly-extending cavities formed by a packing material strategically positioned in the mould preliminary to the moulding and with shaped lengths of metal bar so positioned within the mould that an engageable portion of each metal bar is extendable into a respective cavity-defining area preliminary to the moulding;

b) removing the packing materials from the formed cavities of the walls;

c) precasting in a mould a plurality of floor slabs of appropriate dimensions;

d) positioning the walls and floor slabs in respective positions on the site;

e) securing metal floor tie bars to the floor slabs with engageable outboard tie bar portions being extendable outwardly from each floor slab end;

f) interengaging the engageable outboard portion of a floor tie bar with a respective engageable portion of a side wall-metal bar;

g) covering the floor tie bars with a topping; and wherein the outboard portion of each tie bar is provided with two limbs and whereby said tie bar interengages with the side wall metal bar by inserting the two limbs of the tie bar into the cavity and connecting the two limbs with the shaped portion of the wall metal bar.

4. In a method of construction of a building of two or more storeys comprising:

a) precasting in a mould a plurality of concrete walls each defining outer and inner wall surfaces with each inner wall surface being inclusive of a plurality of inwardly-extending cavities formed by a packing material strategically positioned in the mould preliminary to the moulding and with shaped lengths of metal bars so positioned within the mould that an engageable portion of each metal bar is extendable into a respective cavity-defining area preliminary to the moulding;

b) removing the packing materials from the formed cavities of the walls;

c) precasting in a mould a plurality of floor slabs of appropriate dimensions;

d) positioning the walls and floor slabs in respective positions on the site;

e) securing metal floor tie bars to the floor slabs with engageable outboard tie bar portions being extendable outwardly from each floor slab end;

f) interengaging the engageable outboard portion of the floor tie bar with a respective engageable portion of the side wall metal bar;

g) covering the floor tie bars with a topping; and h) wherein each interengaged floor tie bar and side wall metal bar is retained in position by means of a pin element, with each tie bar having two limbs formed from a metal flat end with the limbs having been formed from a first flat end after the first flat end has been slotted and rolled to fit around the circumferential dimensions of the metal bar.

* * * * *